US007320263B2

(12) United States Patent
Gustafsson

(10) Patent No.: US 7,320,263 B2
(45) Date of Patent: Jan. 22, 2008

(54) CONTROLLER AND METHOD FOR CONTROLLING A CONTROL OBJECT

(75) Inventor: Hans Gustafsson, Boras (SE)

(73) Assignee: Parker Hannifin AB, Boras (SE)

( * ) Notice: Subject to any disclaimer, the term of this patent is extended or adjusted under 35 U.S.C. 154(b) by 525 days.

(21) Appl. No.: 10/679,017

(22) Filed: Oct. 3, 2003

(65) Prior Publication Data

US 2004/0130530 A1 Jul. 8, 2004

(30) Foreign Application Priority Data

Oct. 3, 2002 (SE) ..... 0202933

(51) Int. Cl.
*G05G 9/47* (2006.01)

(52) U.S. Cl. ..... 74/471 XY; 74/531

(58) Field of Classification Search ..... 74/471 R, 74/473.1, 471 XY, 548, 555, 531; 200/6 A, 200/179, 6 R; 273/148 R; 338/163, 161; 137/636.2

See application file for complete search history.

(56) References Cited

U.S. PATENT DOCUMENTS 1,415,176 A * 5/1922 Hughes ..... 244/224
3,394,611 A * 7/1968 Beurrier ..... 74/471 R
3,757,597 A * 9/1973 Vogel et al. ..... 74/471 XY
4,587,510 A 5/1986 Kim
6,002,351 A 12/1999 Takeda et al.
6,128,971 A 10/2000 Papasideris
6,328,127 B1 * 12/2001 Hori et al. ..... 180/333
6,437,771 B1 * 8/2002 Rosenberg et al. ..... 345/156
6,647,820 B2 * 11/2003 McKeown et al. .... 74/471 XY

FOREIGN PATENT DOCUMENTS

EP 0 999 487 A2 5/2000
JP 2001292085 * 10/2001

* cited by examiner

*Primary Examiner*—Richard Ridley
*Assistant Examiner*—James Pilkington
(74) *Attorney, Agent, or Firm*—Christopher H. Hunter

(57) ABSTRACT

The invention relates to a controller and a method for controlling a maneuverable control object and comprising a control lever (1) designed to be manually maneuvered by an operator into various positions and a console (2) in which the control lever is pivotable about at least two intersecting pivot axes and in which the console is provided with a corresponding number of clamps (3, 4) swivel-mounted about their respective swivel axis (5, 6), which clamps are provided with slots (15, 16) through which the control lever (1) extends and along which the control lever can be led. Each clamp (3, 4) cooperates with its respective detention device (27, 28, 31, 32) for locking the associated clamp (3, 4) in at least one predefined detention position and hence limiting the movement of the control lever.

12 Claims, 4 Drawing Sheets

CONTROLLER AND METHOD FOR CONTROLLING A CONTROL OBJECT

CROSS-REFERENCE TO RELATED CASE

The present case claims the benefit of the filing date of Swedish Patent Application Serial No. SE-0202933-8, filed Oct. 3, 2002.

TECHNICAL FIELD

The invention relates to a controller and a method for controlling a maneuverable control object, which controller comprises a control lever and a number of detention devices for limiting the movement of the control lever.

BACKGROUND ART

Controllers comprising a freely movable control lever, also referred to as "joystick", for controlling a maneuverable control object are generally previously known. Since such a control lever is freely movable in a number of directions; it can be a problem for an operator to move the control lever in one plane or about an axis through the pivot point of the control lever.

A previously known control lever of this kind can be seen, for example, from U.S. Pat. No. 4,587,510-A. This device is provided with a pair of cross-laid clamps with slots along which the control lever can be guided. The sole function of the clamps is in this case to comprise fastening points for position-detecting transmitters which are used to monitor the position of the control lever in the guidance of a control object.

A further problem is that current solutions do not allow the control lever to be easily lockable in an optional position. A generally known solution in connection with control levers of this type is instead for them to return to a normal or neutral position when the operator lets go. One example of such a solution can be seen from EP 0 999 487-A2, in which the control lever is spring-loaded toward a central neutral position.

The invention also sets out to solve the aforementioned problems by limiting or wholly locking the movement of a control lever of the aforementioned type.

DISCLOSURE OF INVENTION

The object of the present invention is to be able to limit the movement of the lever, alternatively to wholly lock the control lever in certain positions. The said object is achieved by means of a controller and a method for controlling the controller, as described herein.

According to a preferred first embodiment, the invention comprises a controller for controlling a maneuverable control object, which controller comprises a control lever designed to be manually maneuvered by an operator into various positions and a console in which the control lever is pivotable about at least two intersecting pivot axes and in which the console is provided with a corresponding number of clamps swivel-mounted about the said pivot axes. The clamps are provided with slots through which the control lever extends and along which the control lever can be led. Each cooperates with its respective detention device for locking the associated clamp in at least one predefined detention position and hence limiting the movement of the control lever. The detention devices can preferably be activated individually.

By the term "intersecting pivot axes" is meant that the pivot axes of all incorporated clamps are placed at an angle relative to one another. The angles between respective pivot axes are chosen with regard to the desired function and pattern of movement.

According to one embodiment, the detention devices are designed to lock the control lever in at least one of a plurality of end positions in the said slots. The control lever can then be moved to an end position in the slot belonging to one of the clamps, whereupon a second, transverse clamp is locked. The control lever is thereupon movable in the slot belonging to the second, locked clamp.

According to a further, alternative embodiment, the detention devices can be designed to lock one of the said clamps in any one of a number of predefined positions, the control lever only being maneuverable in the slot of the locked clamp.

According to an alternative embodiment, the detention devices are designed to lock the control lever in an optional position between a pair of end positions in the said slots. As has been described above, the control lever is in this case movable in the slot belonging to the second, locked clamp.

In all three embodiments above, it is, of course, possible to choose freely which clamp is to be locked and to lock a further clamp in order to lock the control lever in a fixed position.

The controller comprises at least one detention device for a respective clamp, in which each detention device comprises a detention arm. The detention arm is at its one end swivel-mounted in the console and extends transversely to the pivot axis for the respective clamp. It can also be provided with engagement members having a contact surface which, in the detention position, engages with a cooperating contact surface of the respective clamp.

The detention arm, at its other end, is provided with an activatable member when activated, moves the detention arm into the detention position locking the clamp. An activatable member of this kind may comprise an electromagnet, a pneumatically or hydraulically operated piston-cylinder unit, a mechanically operated cam, or the like.

In certain cases it can be desirable for the detention devices only to be activatable when the control lever is placed in certain predefined positions. In order to achieve this, the console can be provided with some form of position transmitter, preferably a contactless transmitter, coupled to a control unit, for detecting the position of the control lever relative to the console.

BRIEF DESCRIPTION OF DRAWINGS

The invention will be described in greater detail below based on an illustrative embodiment, with reference to the appended diagrammatic drawings.

MODES FOR CARRYING OUT THE INVENTION

Figure 1:
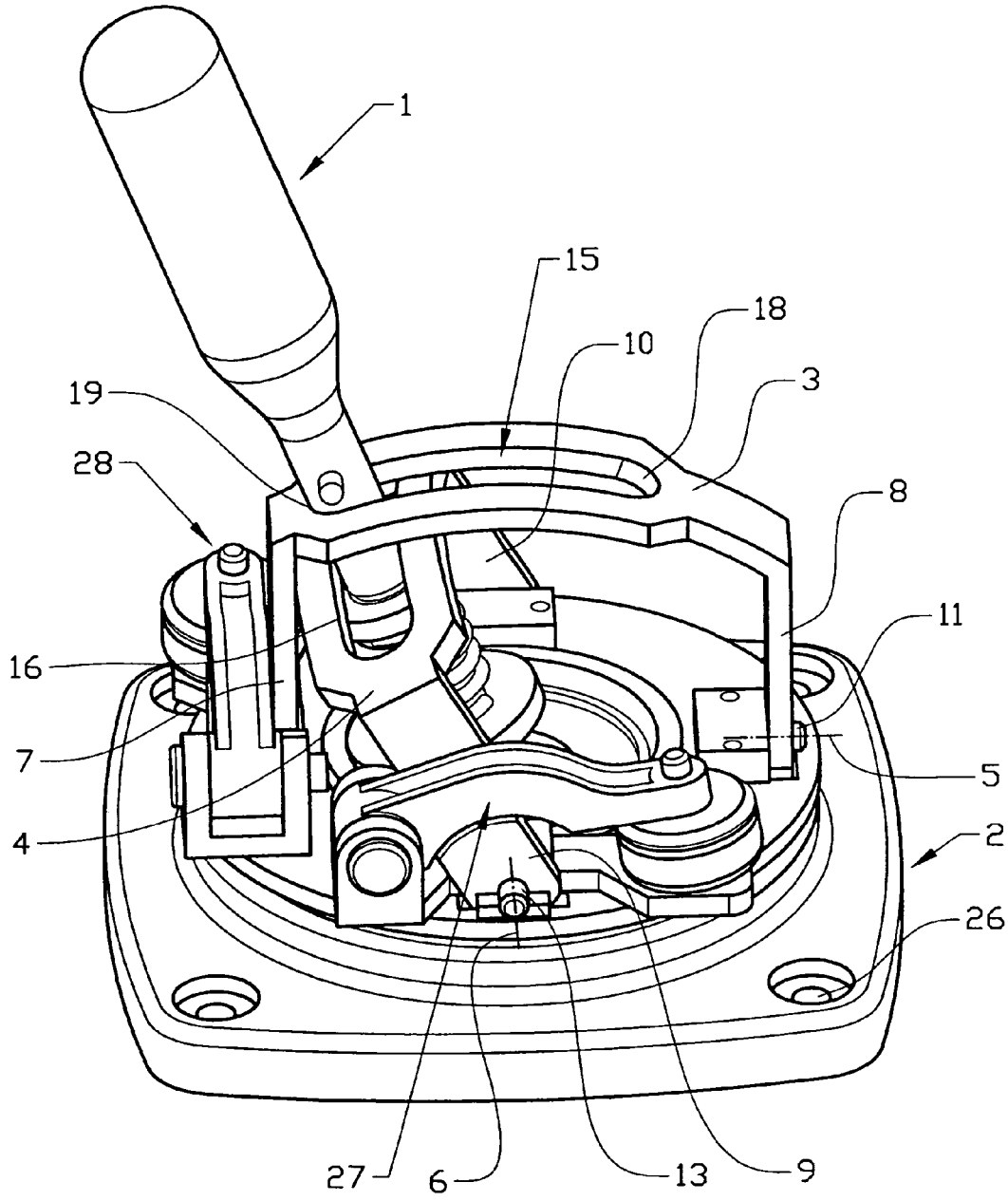
FIG. 1 shows a projection of a first embodiment of the device, in which the control lever is placed in one of its end positions.
Figure 2:
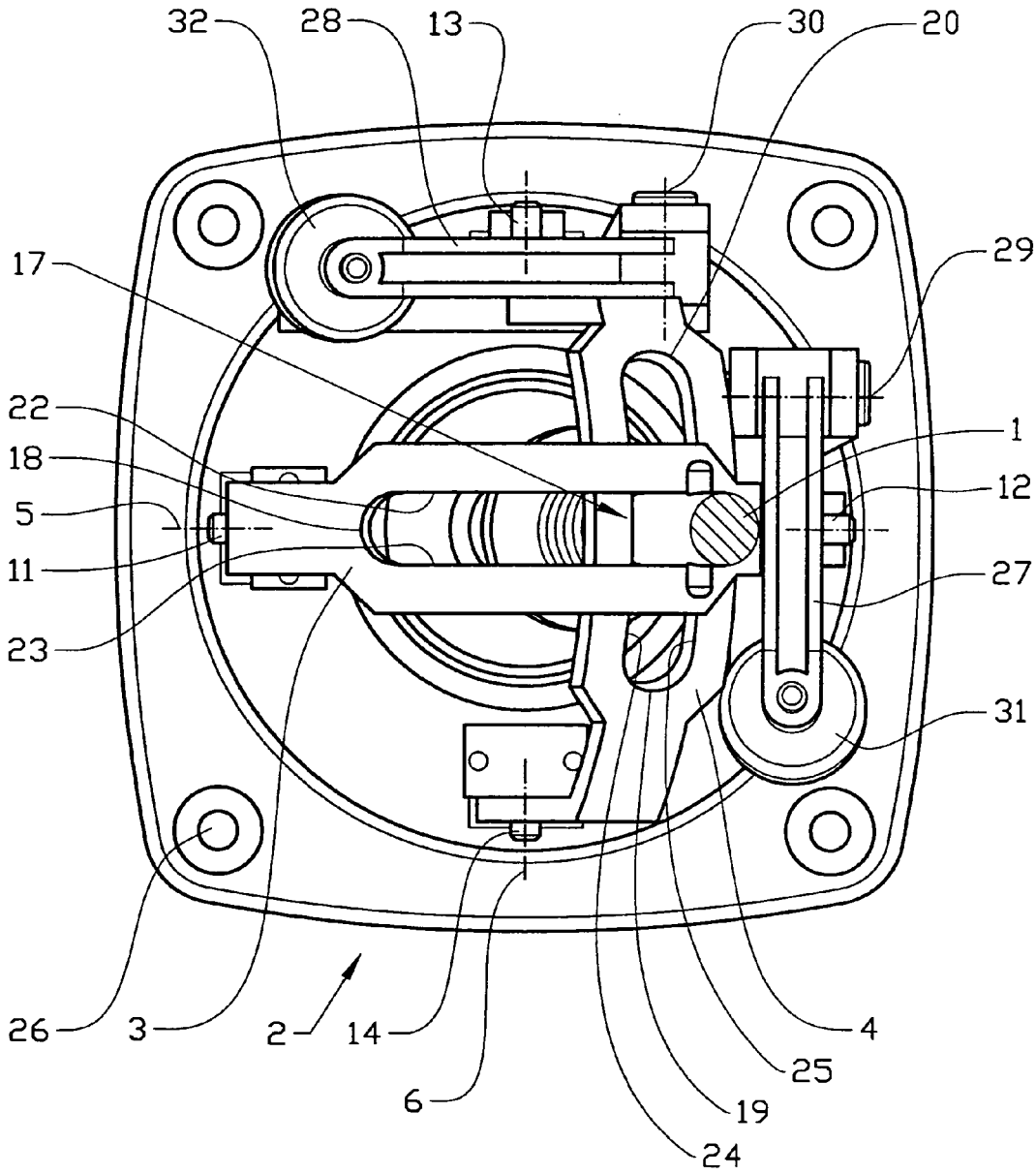
FIG. 2 shows a top view of the device in FIG. 1 with the same control lever position.

In the example shown in FIGS. 1, 2 and 3, the controller is constructed as follows. The principal parts are comprised by a control lever 1 and a control console 2 in which the control lever is pivotably mounted. The mounting is not shown in FIG. 1 but may comprise a ball joint in the control console 2, or as a cardan suspension having two cross-laid pivot axes, forming a pivot point. The movement of the control lever 1 with respect to the swivel movement about the pivot point is determined by two cross-laid clamps 3, 4, which can be swiveled about their respective swivel axis 5, 6. In order not to disturb each other's movement, the clamps are arranged as an upper clamp 3 and a lower clamp 4. The two swivel axes 5, 6 of the clamps are cross-laid relative to each other, in the illustrated example perpendicular to each other. In addition to this, each end 7, 8, 9, 10 of each clamp 3, 4 is pivotably fastened by means of its respective pivot point to the control console 2. Each swivel axis is arranged in the form of a pivot pin 11,12, 13, 14 in a hole in a console section at each clamp end 7, 8, 9,10. The clamps 3, 4 are provided with a respective longitudinal slot 15, 16, which slots are arranged to cross each other, the control lever 1 extending transversely through the slots 15, 16 at their point of intersection 17 (see FIG. 2). The slots 15; 16 are closed and have end edges 18, 19, 20, 21 which form end stops for the swivel movement of the control lever. The longitudinal edges 22, 23, 24, 25 of the slots 15, 16 form lateral guides for the control lever, the width of the slots with suitable tolerances somewhat exceeding the cross-dimension of the control lever, in this case its diameter. The control console 2 is arranged as a fixed plate with a number of fixing holes 26 for fixing the controller to a suitable base, for example an instrument panel, an arm rest or the like.

The controller according to a preferred embodiment is provided with two detention devices in the form of a pair of detention arms 27, 28. Each detention arm is at its one end mounted in a pivot point 29, 30. Such a mounting can comprise a spring-back device (not shown) made of an elastic material, or a spring which endeavours to hold the detention arm in an unloaded position. At its other end, the detention arm 27, 28 is provided with an activatable member in the form of an electromagnet 31, 32, which, when activated, moves the detention arm 27, 28 into a detention position for locking of the particular clamp 3, 4.

Each detention arm 27, 28 is provided with engagement members having a contact surface 33 which, in the detention position, engages with a cooperating contact surface 34 placed on the respective clamp 3, 4 in connection with one of the clamp ends 7, 9. The contact surface 34 of the respective clamp is preferably arranged as a part-cylindrical surface with a predefined radius relative to the swivel axis of the respective clamp. According to the embodiment shown in FIGS. 1-3, the contact surface of detention arm 27, 28 has a profile which allows cooperation between the respective contact surfaces 33, 34 when the control lever has been moved into bearing contact against the end edge 19 of the slot 15 in the upper clamp 3. The control lever is then locked in the end position of the upper clamp 3 but can be moved transversely to the said clamp 3 in the slot 16 of the lower clamp 4.

The detention arm is preferably exchangeable in order to allow functions and pattern of movement to be changed. A detention arm provided with an even contact surface 34 allows the respective clamp 3, 4 to be freely lockable in all positions along its guide slot 15, 16. A detention arm provided with contact surfaces 34 in the form of a recess in connection with both ends of the detention arm allows the respective clamp 3, 4 to be lockable in the respective end positions of the guide slots 15, 16. A detention arm provided with contact surfaces 34 in the form of a plurality of recesses in the lower side of the detention arm allows the respective clamp 3, 4 to be locked in a corresponding number of predefined positions.

According to an alternative embodiment, the said electromagnet may be a spring-loaded solenoid, in which case the solenoid can be used to return the detention arm to the unloaded position.

The activable member can also be comprised by a pneumatically or hydraulically operated piston/cylinder unit, a mechanically operated cam, or the like.

Figure 3:
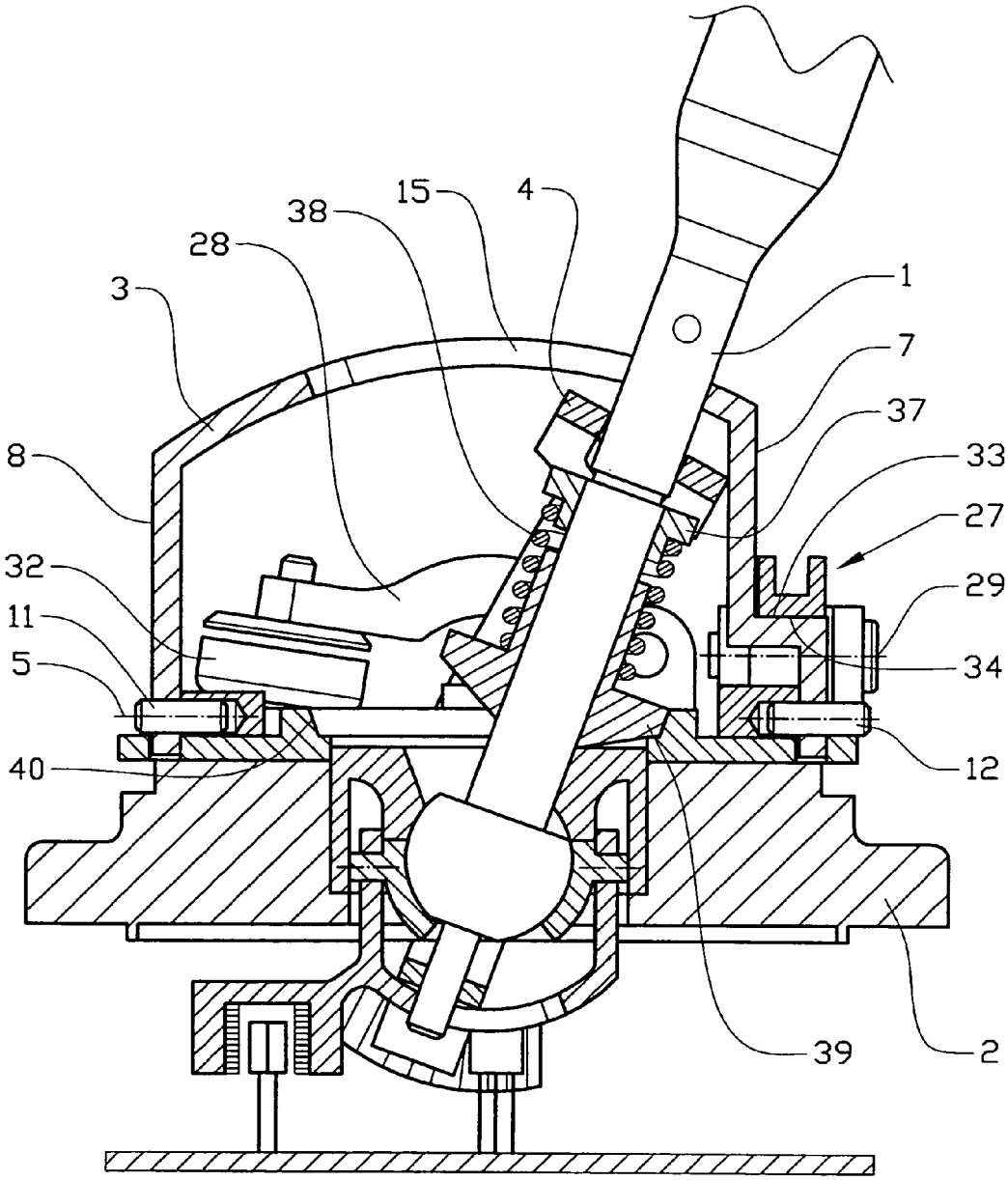
FIG. 3 shows a cross-section of the device in FIG. 2 in the plane A-A.

FIG. 3 also shows an arrangement for returning the control lever to a central neutral position should none of the detention arms be activated when the operator lets go of the control lever. This arrangement comprises a fixed stop 37 mounted around the control lever 1, and a helical spring 38, which bears against the said stop 37 and spring loads a guide body 39 in the direction of the pivot point of the control lever. The guide element bears against a guide 40 placed in the upper part of the console 2. If none of the detention devices are activated when the operator lets go of the control lever, the spring-loaded guide body 39 will be pressed against the guide 40 and move the control lever into a neutral position.

Figure 4:
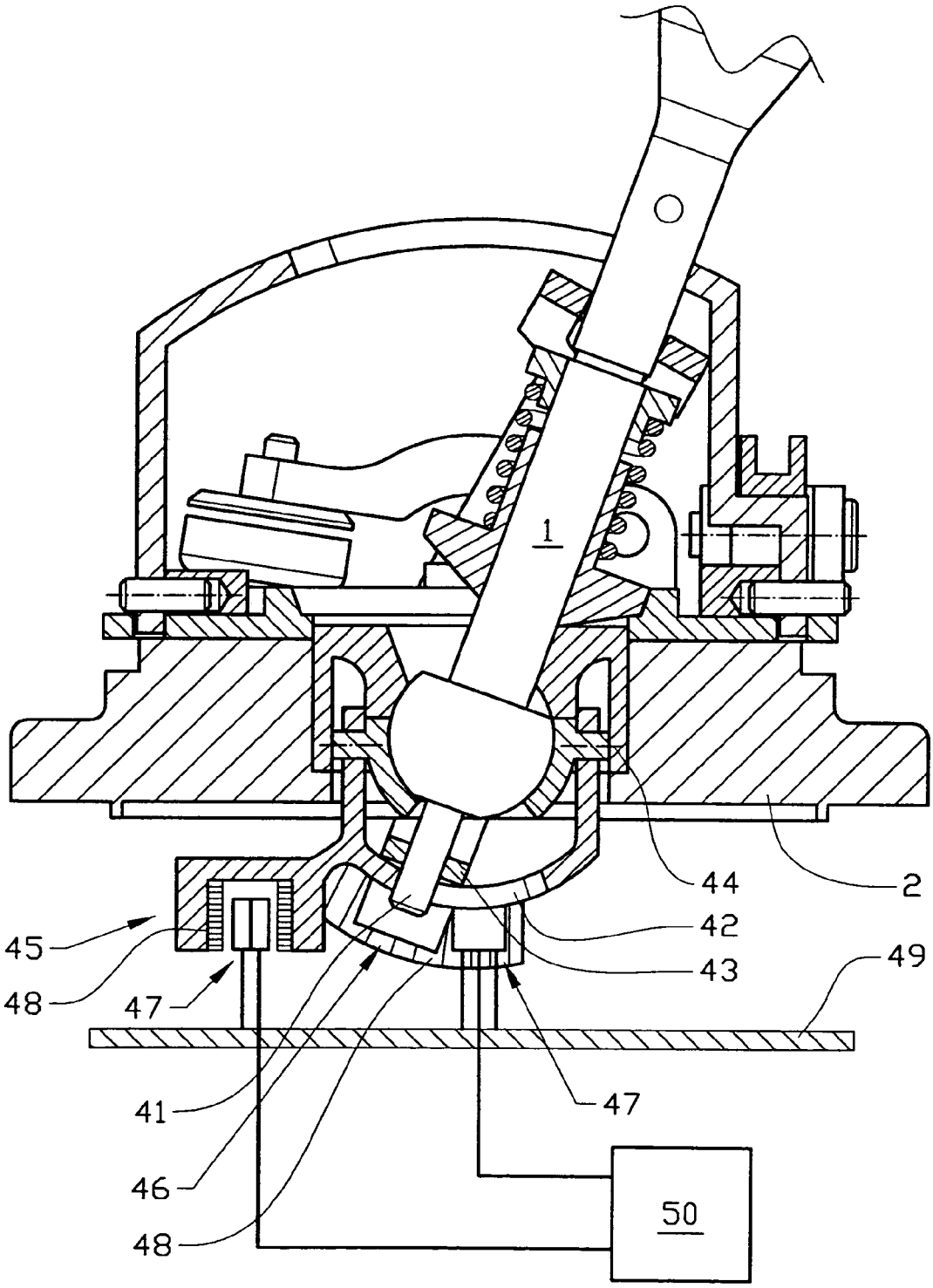
FIG. 4 shows a part-enlargement of the device in FIG. 3, displaying the position transmitter of the control lever.

FIG. 4 comprises an enlarged partial cross-section of FIG. 3 and shows an arrangement comprising a sensor for indicating the instantaneous position of the control lever. The sensor is preferably contactless and is in a Hall sensor.

The ball joint of the control lever 1 is provided with a guide pin 41 placed on the diametrically opposite side of the ball joint relative to the control lever 1. The guide pin 41 cooperates with through guide slots in a pair of cross-laid clamps 42, 43 which are placed at right angles relative to each other and swiveled about their respective swivel axis 44. Each end of the respective clamp 42, 43 is pivotably fastened by means of its respective point to the control console 2.

The one end of the respective clamp 42, 43 is provided with a holder 45, 46, which bears a magnetic element in the form of a plurality of magnetic and negative poles 47 placed on each side of a Hall element 48, which, in turn, is mounted on a fixed-mounted holder 49. Each magnetic element is divided into a number of sectors, for example circular segments, whereby a displacement of the respective pair of magnets induces a current proportional to the position of the clamp in the Hall element by using a pair of Hall elements cooperating with magnetic elements fixed to two cross-laid clamps 42, 43 controlled by the guide pin 41, a position sensor is obtained whose output signal indicates the position of the control lever 1. The respective Hall element 47, 48 is coupled to a control unit 50, which is programmed to execute certain predefined measures depending on the signals from the sensor.

Activation of the detention devices for locking of the control lever can be effected in a number of different ways. For example, one or both detention devices can be activated automatically when the control lever is brought to a certain position. When the position sensor indicates such a position, one or both of the electromagnets is/are switched on and locks the control lever. This can be done directly or with a certain time delay. Alternatively, the locking can also be activated manually. Release of the detention is expediently effected manually. This can either be done with a simple changeover switch or in combination with some other measure. This latter can be relevant when the operator has to keep hold of the control lever when the detention is released, should it not be desirable for the control lever to return to its neutral position when freed. Alternatively, this can be achieved by placing a changeover switch on the control lever.

The preferred example above shows two clamps disposed with their swivel axes arranged perpendicular to each other. Depending on the desired function and/or pattern of movement, it is also possible to choose a different angle between the swivel axes. In certain cases, it can also be desirable to provide the console with one or more further clamps, in addition to those described above, with a view to allowing rectilinear displacement of the control lever in a number of planes. In these cases too, the functioning of the device with cooperating slotted clamps with associated detention devices is, however, the same.

The invention claimed is:

1. A controller, comprising:

a console; and a control lever pivotally mounted in the console about at least two intersecting pivot axis, the console including a pair of clamps swivel mounted about respective swivel axis, each clamp including an elongated slot through which the control lever extends and along which the control lever can be moved, and a detention device associated with each clamp and individually operable for locking each clamp in at least one predefined detent position to thereby limit the movement of the control lever, and wherein each detention device comprises a detention arm, which at one end is swivel-mounted in the console and extends transversely to the respective clamp and is provided with at least one contact surface along its length which, in the detention position, engages transversely with a contact surface of the respective clamp, and wherein each detention arm at its other end, is provided with activation means for moving the detention arm transversely into the detention position.

2. The controller as in claim 1, wherein the activation means comprises an electromagnet, which, when activated, draws the detention arm transversely into the detention position and against the clamp.

3. Controller for controlling a maneuverable control object, comprising a control lever designed to be manually maneuvered by an operator into various positions and a console in which the control lever is pivotable about at least two intersecting pivot axes and in which the console is provided with a corresponding number of clamps swivel-mounted about their respective swivel axis, which clamps are provided with slots through which the control lever extends and along which the lever can be led, individually-activated detention devices for restricting movement of the clamps, each clamp cooperates with a respective detention device for locking the associated clamp in at least one predefined detention position and limiting the movement of the control lever, wherein at least one of the detention devices is designed to lock the control lever in at least one of a plurality of end positions in one of the said slots in one of the said clamps, the control lever being maneuverable in the slot of the locked clamp, wherein each detention device comprises a detention arm, which at one end is swivel-mounted in the console and extends transversely to the respective clamp and is provided with at least one contact surface along its length which, in the detention position, engages transversely with a contact surface of the respective clamp, and wherein at another end, the detention device includes an activation member which draws the detention arm transversely into the detention position against the respective clamp.

4. Controller according to claim 3, wherein the at least one detention device is designed to lock one of the said clamps in any one of a number of predefined positions, the control lever only being maneuverable in the slot of the locked clamp.

5. Controller according to claim 3, wherein the at least one detention device is designed to lock the control lever in an optional position between a pair of end positions in one of the said slots in one of the said clamps, the control lever only being maneuverable in the slot of the locked clamp.

6. Controller according to claim 3, wherein the detention devices are designed to lock the control lever in an optional position between a pair of end positions in both of the said slots, the control lever being locked in this position.

7. Controller according to claim 3, wherein each activation member includes an electromagnet, which, when activated, draws the detention arm transversely into the detention position.

8. Controller according to claim 3, wherein each detention arm, at its other end, is provided with a controllable piston-cylinder unit, which, when activated, draws the detention arm into the detention position.

9. Controller according to claim 3, wherein each activation member includes a controllable cam which, when activated, moves the detention arm transversely into the detention position.

10. Controller according to claim 3, wherein the detention devices are only activatable when the control lever is placed in certain predefined positions.

11. Controller according to claim 10, wherein the console is provided with a contactless transmitter, coupled to a control unit, for detecting the position of the control lever relative to the console.

12. Method for controlling a maneuverable control object, whereby an operator maneuvers a control lever into various positions relative to a console in which the control lever is pivotable about at least two intersecting pivot axes and in which the console is provided with a corresponding number of clamps swivel-mounted about their respective swivel axis, which clamps are provided with slots through which the control lever extends and along which the control lever can be led, individually-activated detention devices for restricting movement of the clamps, wherein each clamp can be locked in at least one predefined detention position by activation of a detention device for the respective associated clamp and can hence limit the movement of the control lever and wherein each detention device comprises a detention arm, which is: i) swivel-mounted at one end in the console and extends transversely to the respective clamp; and ii) provided along its length with at least one contact surface which, in the detention position, engages transversely with a contact surface of the respective clamp, and iii) provided with an electromagnet at another end which, when activated, draws the detention arm transversely into the detention position and against the clamp.

* * * * *